US005238234A

United States Patent [19]

Kerber et al.

[11] Patent Number: 5,238,234

[45] Date of Patent: Aug. 24, 1993

[54] CONTINUOUS-OPERATION DEVICE FOR TREATMENT OF LEATHER AND SIMILAR MATERIALS

[76] Inventors: Werner Kerber, Auf der Herrenmauer 34, Kelkheim D-6233, Fed. Rep. of Germany; Rocco Finco, Via S. Rocco 40, Bassano del Grappa, Italy

[21] Appl. No.: 730,772

[22] PCT Filed: Nov. 29, 1990

[86] PCT No.: PCT/EP90/02050

§ 371 Date: Oct. 2, 1991

§ 102(e) Date: Oct. 2, 1991

[87] PCT Pub. No.: WO91/08315

PCT Pub. Date: Jun. 13, 1991

[30] Foreign Application Priority Data

Nov. 29, 1989 [DE] Fed. Rep. of Germany ..... 3939461

[51] Int. Cl.[5] ..... B65H 29/02

[52] U.S. Cl. ..... 271/1; 271/176; 271/228

[58] Field of Search ..... 271/1, 228, 249, 247, 271/252, 176

[56] References Cited

U.S. PATENT DOCUMENTS

| | | | |
|---|---|---|---|
| 4,588,184 | 5/1986 | Jeschke | 271/252 X |
| 4,776,579 | 10/1988 | Romand | 271/228 |

FOREIGN PATENT DOCUMENTS

| | | |
|---|---|---|
| 654773 | 1/1938 | Fed. Rep. of Germany . |
| 2337210 | 2/1975 | Fed. Rep. of Germany . |
| 2620667 | 12/1977 | Fed. Rep. of Germany . |
| 314367 | 5/1983 | Fed. Rep. of Germany . |
| 2563235 | 10/1985 | France . |
| 2584091 | 1/1987 | France . |

*Primary Examiner*—Richard A. Schacher
*Attorney, Agent, or Firm*—Lalos & Keegan

[57] ABSTRACT

A continuous-operation device for the treatment of a leather piece and similar materials, comprising a work station including a roller unit including a pair of rollers and through which the leather piece is moved, the work station including an inlet side and an outlet side, a traversing path upon which the leather piece is transversely moved, the traversing path extending from the inlet side and through the work station to the outlet side, a gripper for removal of the leather piece from one of the pair of rollers as the leather emerges from the work station outlet side, the gripper also for traversal movement of the leather piece after it emerges from the work station outlet side, a drive for driving the gripper, the gripper being operatively connected to the work station outlet side and movably mounted on the drive.

33 Claims, 12 Drawing Sheets

CONTINUOUS-OPERATION DEVICE FOR TREATMENT OF LEATHER AND SIMILAR MATERIALS

The invention relates to a continuous-operation device for the treatment of leather and similar materials, in particular a printing, dyeing, smoothing, or dewatering device, with a traversing path that extends through at least one roller unit, especially a pair of rollers. Such continuous-operation devices are frequently and widely used in tanning and leather working. Conveyor, vacuum, and pressure equalization belts, or similar endless-loop flexible elements often extend along the traversing path between the surfaces of the roller pair on the outlet side or, if applicable, of upstream roller pairs.

In the discharge area of the roller unit, the emerging edge area of the leather pieces adhere more or less strongly to a roller surface or to the surface of a revolving belt extending through the roller pair involved. For the sake of simplicity, a roller surface will be referred to exclusively in this context in the following discussion.

Generally speaking, the problem arises of quickly and reliably releasing the edge area of the emerging leather pieces from the roller surface to which the leather adheres so that the continuous operation process will not be impeded and the leather will not be damaged. Hence the problem to be solved by the invention is creation of continuous operation devices of the type referred to in the foregoing that permit such separation of the leather from the roller outlet in continuous operation.

SUMMARY OF THE INVENTION

This problem is solved by the two alternative embodiments of the present invention, which in principle are to be used separately but if desired can be applied advantageously together in appropriate combinations. They are based on a common inventive concept. Among other things, this concept involves keeping at least the sensitive grain side of the leather free from relative movement with respect to machine elements, that is, from undesirable sliding or frictional application, and thus from damage, during the process of emergence over the length of the leather piece, inside the leather surface, except at most in the narrow area of the emerging edge. This is particularly important in the case of continuously operating staining and imprinting machines, inasmuch as the grain or outer side of the leather just provided with stain is still sensitive to pressure. Both the pulling of the leather by driven gripping means and the release by means of compressed air jets provide optimum satisfaction of these operational requirements. The first embodiment is especially well suited for leather having surfaces difficult to separate from the roller.

Other objects and advantages of the present invention will become more apparent to those persons having ordinary skill in the art to which the present invention pertains from the following description taken in conjunction with the accompanying drawings.

DETAILED DESCRIPTION

Figure 1:
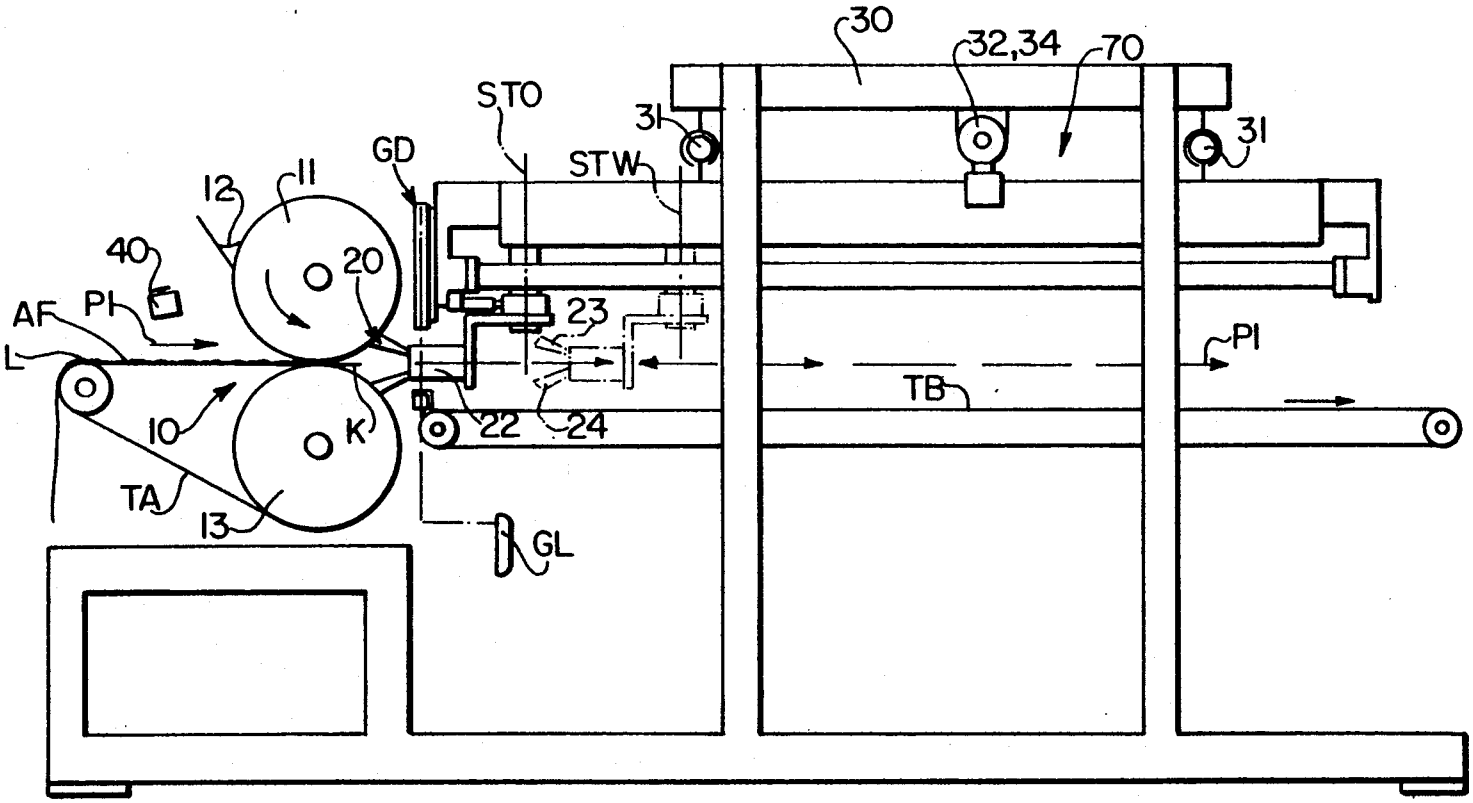
FIG. 1 is a side view of a leather staining machine of the present invention.
Figure 2:
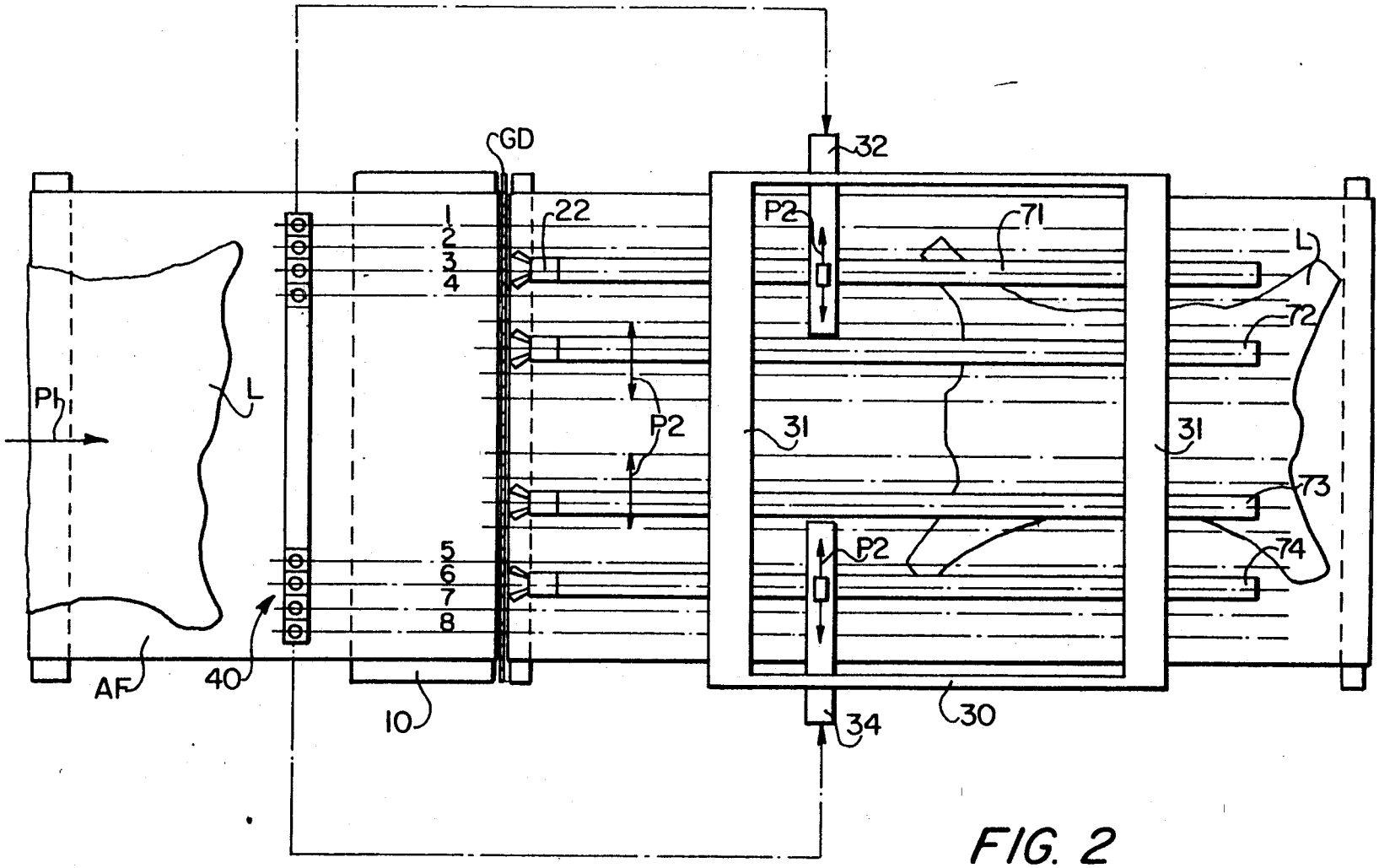
FIG. 2 is a plan view of the embodiment of FIG. 1.

Referring to FIGS. 1 and 2, a leather staining machine is shown designed as a continuous operation machine, with a continuous path for leather pieces L extending in the direction of arrow P1 through a roller unit (10). The roller unit comprises an upper stain roller 11 with stain trough 12 and a lower counterpressure and transfer roller 13 across which a transition belt TA extends. The upper side of transition belt TA forms a bearing surface AF for the leather pieces to be fed. In the situation shown in FIG. 1, the leading edge K of a leather piece has reached the outlet side of the roller unit. Gripping means 20 are mounted here for removal of the emerging leather pieces. These gripping means 20 are movably mounted in the direction of passage and are connected to drive means 70 that act in the direction of extraction of the leather pieces. As is to be seen from FIG. 1, a lower positioned outlet conveyor belt TB connected to the discharge area of the roller unit extends in direction P1 to the end of the machine on the outlet side.

During operation, the emerging edge of the leather K is released by the gripping means from the surface of the belt to which the leather more or less strongly adheres, that is, generally speaking from the surface of the stain roller, and is gripped by these means. The drive means 70 are then activated and the gripping means 20 pull the edge of the leather in synchronization with the speed of discharge of the leather at the outlet from the roller unit as the leather is progressively released from the surface of the conveyor belt or roller in direction P1 to an assigned end position, for example, into the area of the end of the machine on the outlet side. In the process, the central area of the length of the leather piece subsides onto the conveyor belt TB, which is driven in synchronization with the drive means 70. Hence the leather, which is still damp with stain and is sensitive, is spread out gently and free of folds, ready for removal.

In the example shown, the gripping means comprise four gripping means 20 that are arranged across the operating width of the roller unit 10 and that grip the edge area K of the emerging leather pieces. As FIG. 2 shows, there is provided for each gripper inside the drive means 70 a stripping and driving device 71, 72, 73, or 74 that may be activated individually, in the form of a compressed air cylinder that extends more or less over the useful length of the conveyor belt TB.

Figure 3:
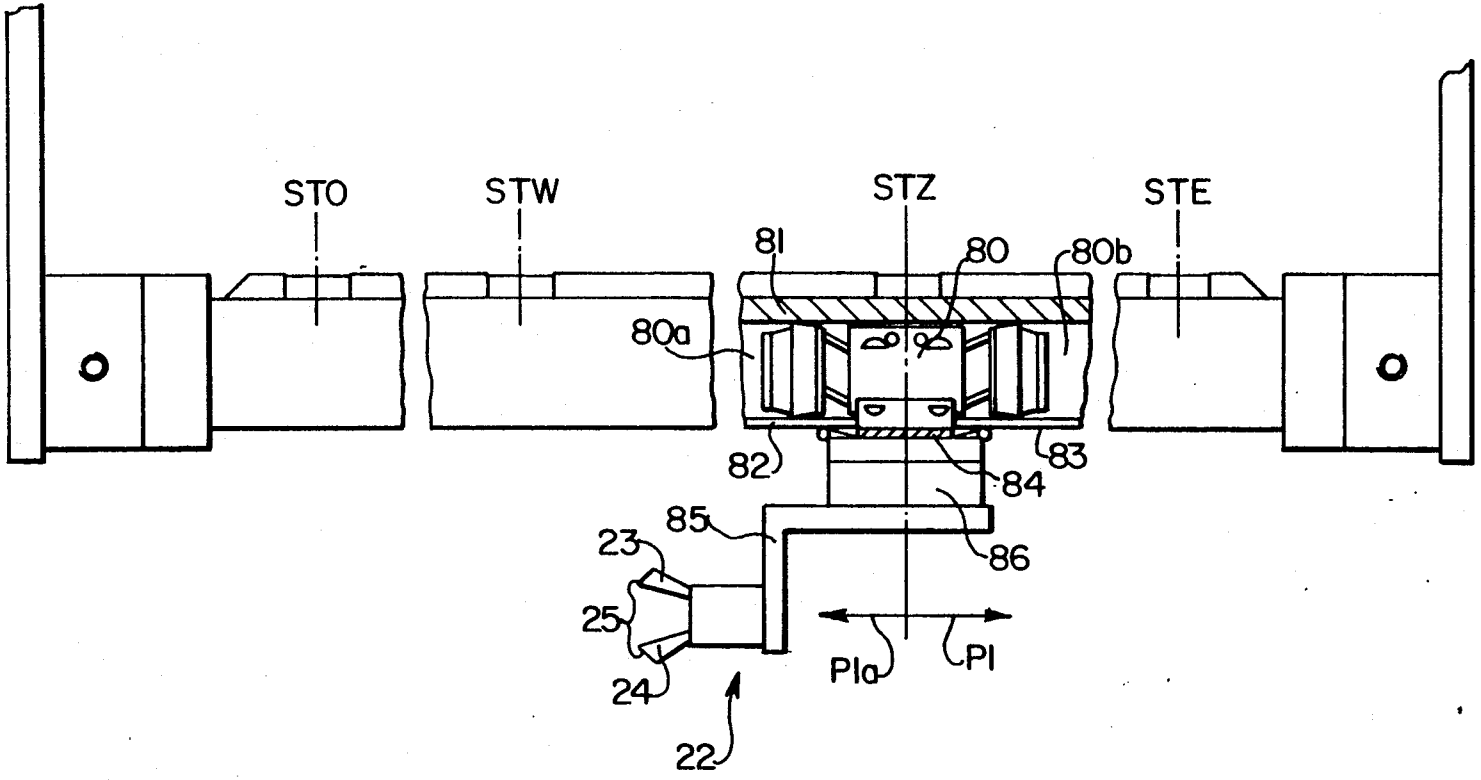
FIG. 3 is a partial longitudinal section of the gripping means of the embodiment of FIGS. 1 and 2.

A compressed air cylinder such as this, 71 for example, is of commercially available design; a partial longitudinal section of a cylinder is shown in FIG. 3. Accordingly a double acting piston 80 is mounted in a cylindrical jacket 81 that is provided with a slit in the jacket 82 extending parallel to the axis. Pressure chambers 80*a*, 80*b* on both sides of the piston are sealed off from the exterior by a soft elastic sealing element 83 that extends over the length of the slit in the jacket 82 and itself has a longitudinal slit 83, and are sealed off from each other by means of a sealing slide 84 fastened on the piston. Longitudinal slit motion seals for piston and cylinder systems are universally known and need no special explanation here. An angular support element 85 and a coupling element 86 connect the gripper 22 to the piston. Alternate pressure loading of the cylinder results in a shuttle type mode of operation, specifically, the stripping movement of the individual grippers, already explained, along the conveyor belt TB in the direction of arrow P1, and return movement in the opposite direction, that of P1a.

It goes without saying that a common strip and drive device can if desired be provided for a plurality of grippers.

An essential feature of the invention in this context is that, as is shown in FIG. 2, at least one gripper 22 or at least one gripper group is adjustably mounted in direction P2 transversely to direction of passage P2, within the operating width of the roller unit 10. In the example shown, the two outer grippers are assembled together with their drive devices 71 and 74 to form a laterally adjustable modular unit.

For this purpose, the pertinent compressed air cylinders are slidably mounted on rails 31, independently of each other, inside a framelike rack element 30, and each is coupled to a selectively activated transverse adjustment device 32 or 34 in the form of a compressed air cylinder. In addition, a transverse control device 40 is provided with a program control unit that has a plurality of predetermined and optionally activatable transverse position adjustments 1 to 4 and 5 to 8 inside the operating width of the roller unit. The transverse control device 40 is mounted as a structural group resembling a cross-arm with upper transverse adjustment selection keys and mounted conveniently for operation above the leather application surface AF.

The points of application of the stripping forces along the emerging edge of the leather can accordingly be adapted to different outer contours and qualities of the leather pieces to be worked. If desired, a larger number of grippers may of course be provided and preferably may be designed so as to be laterally adjustable, either individually or in groups.

As may be seen from FIG. 3, several position detectors ST0, STW, STZ, and STE are mounted on the compressed air cylinder and are coordinated with specific positions of the piston 80, that is, with the pertinent gripping means 20 as well, along their path of movement. These position detectors are activated by the piston 80 to generate a control signal, in the example of a dual logic signal one having the value 1, when the midpoint of the length of the piston reaches the switching position of the pertinent detector, as indicated by the broken line. Conventional inductance proximity switches, for example, are used for the position detectors, the piston being provided in the usual commercial version with a control magnet installed at the midpoint of its length. The detectors are associated with respect to the gripping means 20 with an initial position on the roller outlet (ST0), a waiting position (STW), anintermediate position (STZ), and an end position (STE). These detectors, and STZ and STE in particular, can be installed so as to be adjustable along the path of movement of the gripper. This arrangement of detectors serves the purpose of control of the forward movement or stripping movement and the return travelmovement; this control remains to the explained in what follows.

Figure 4:
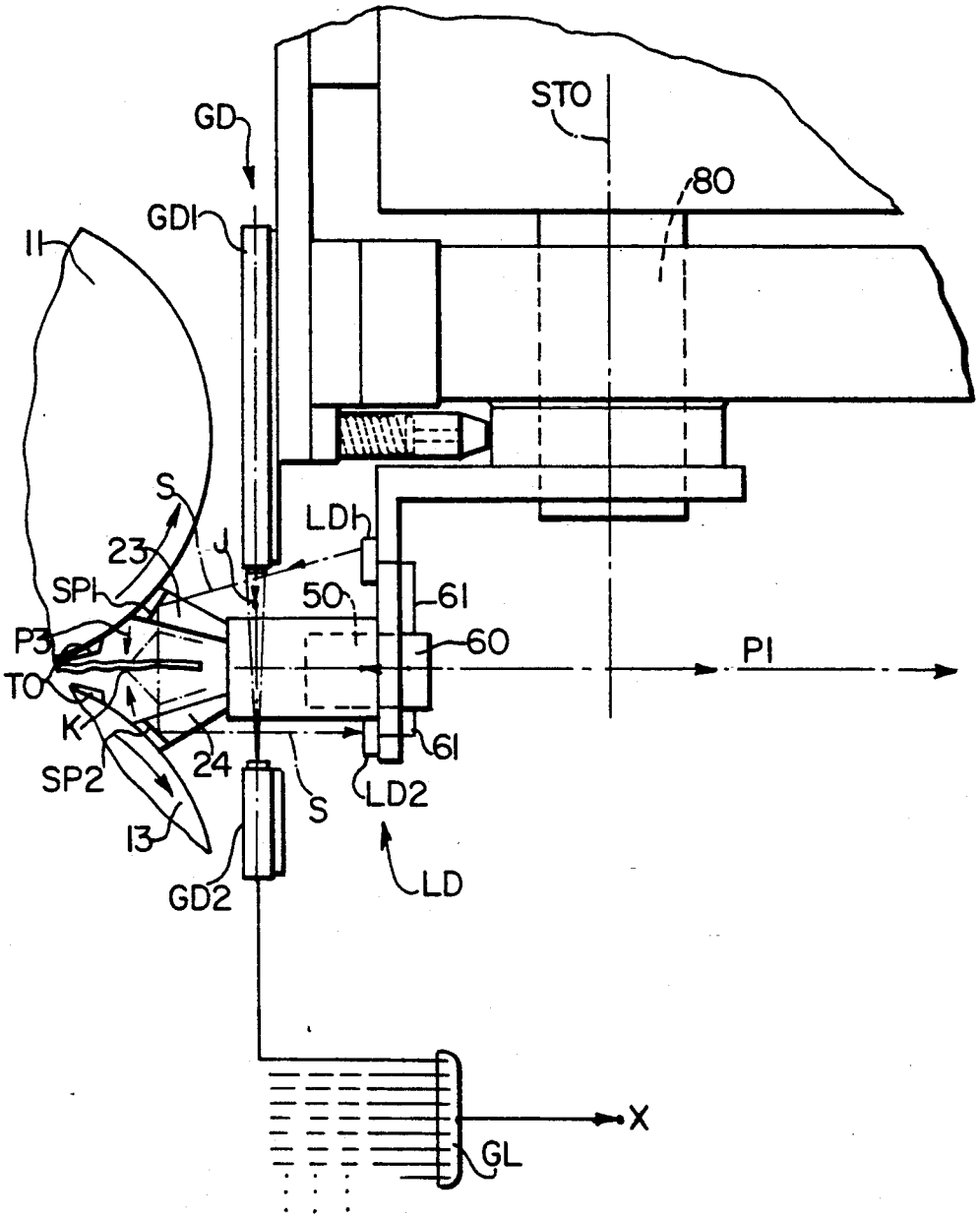
FIG. 4 is an enlarged side view of the roller discharge area of the embodiment of FIGS. 1 through 3.

FIG. 4 shows, on a larger scale, a section of the roller discharge area from FIG. 1 and a gripper 22 in the initial position ST0 (for the sake of clarity, the gripper movement positions will be identified by the designations ST0, STW, STZ, and STE of the corresponding position detectors, inasmuch as the invariable longitudinal displacement between gripper and piston mid-length is negligible). The tonglike structure of the gripper 22, with clawlike gripping elements 23, 24 that can be moved from an open position and a closed position (indicated by broken lines) is illustrated in the drawing. The gripping elements have a tip area designed as strippers 25, which, when the gripping elements are in the open position illustrated, with the grippers in the open position ST0, that is, in the initial position for the gripping operation, are positioned in the immediate vicinity of an associated conveyor surface TÓ of the rollers 11, 13 (that is, of the feed belt TA not shown here). The leather edge area that on emergence generally adheres to a conveyor belt or roller surface is thus in each instance reliably freed by one of the strippers 25 and reaches the area between the open gripping elements 23, 24. This situation is illustrated by solid lines in FIG. 3.

Each gripper is associated with a detector LD that detects entry of the leather edge area into the space between the opened gripping elements and triggers immediate closing of these elements. For simple applications, such as stiff leather or an emerging leather edge of uncomplicated outline, the configuration costs may be lowered by providing a leather presence detector for individual grippers only, or in an extreme case for only one gripper.

In the example under discussion, an optoelectronic detector with a light emitter LD1 and a light sensor LD2 are provided. The scanning beam path S, indicated by a broken line, extends from the emitter LD1 to a first reflecting surface SP1 mounted on the inner front side of the transparent gripping element 23, thence through the interior of the grippers to the also transparent gripping element 24 to a second reflecting surface SP2 mounted inside the latter, to the sensor LD2. Mounted on the gripper is a feed and control unit 60, shown here in schematic form only, that supplies power in the conventional manner over lines 6 to the emitter and processes the output signals of the sensor. A positioning device 50 of conventional design, also indicated only schematically by broken lines, with a suitable servomotor, receives a control pulse from the feed and control unit 60 and causes the gripping elements to close along arrows P3 as indicated by broken lines. As is to be explained in greater detail below, after a brief delay that ensures firm gripping of the leather edge, detection of the presence of leather triggers advance of the grippers as indicated by arrow P1.

The detection of the presence of leather as described in the foregoing is associated with the individual grippers or groups of grippers. In addition, a detection device GD is present as shown by FIGS. 2 and 4. This device extends over the entire width of the roller discharge area, or a part of this area, monitoring this total area for the presence of material or freedom from emerging material. In the example under discussion, this device comprises a series, extending over the operating width, of light emitters GD1 mounted above the exit plane, together with pertinent sensors GD2 that are mounted below this plane. The pertinent scanning beam path s thus penetrates the plane of the material. The spacings and the position of the scanning units consisting of emitters and sensors are so selected that sufficiently constant coverage of the material is achieved. A particular achievement of this solution is that the scanning beams pass over the grippers 22 while they are in their initial position. However, the progress of movement can generally be readily designed so that even masking of scanning beams by the grippers is no disruptive factor, inasmuch as this masking can occur only in the initial position. As is indicated in FIG. 4, the sensor output signals of the scanning units, specifically, a logical 1 for the presence of material, are coordinated in a NOR logic unit GL. Hence an output signal of the latter, X, representing the value 1 has the meaning "roller discharge area is free of material."

Figure 5:
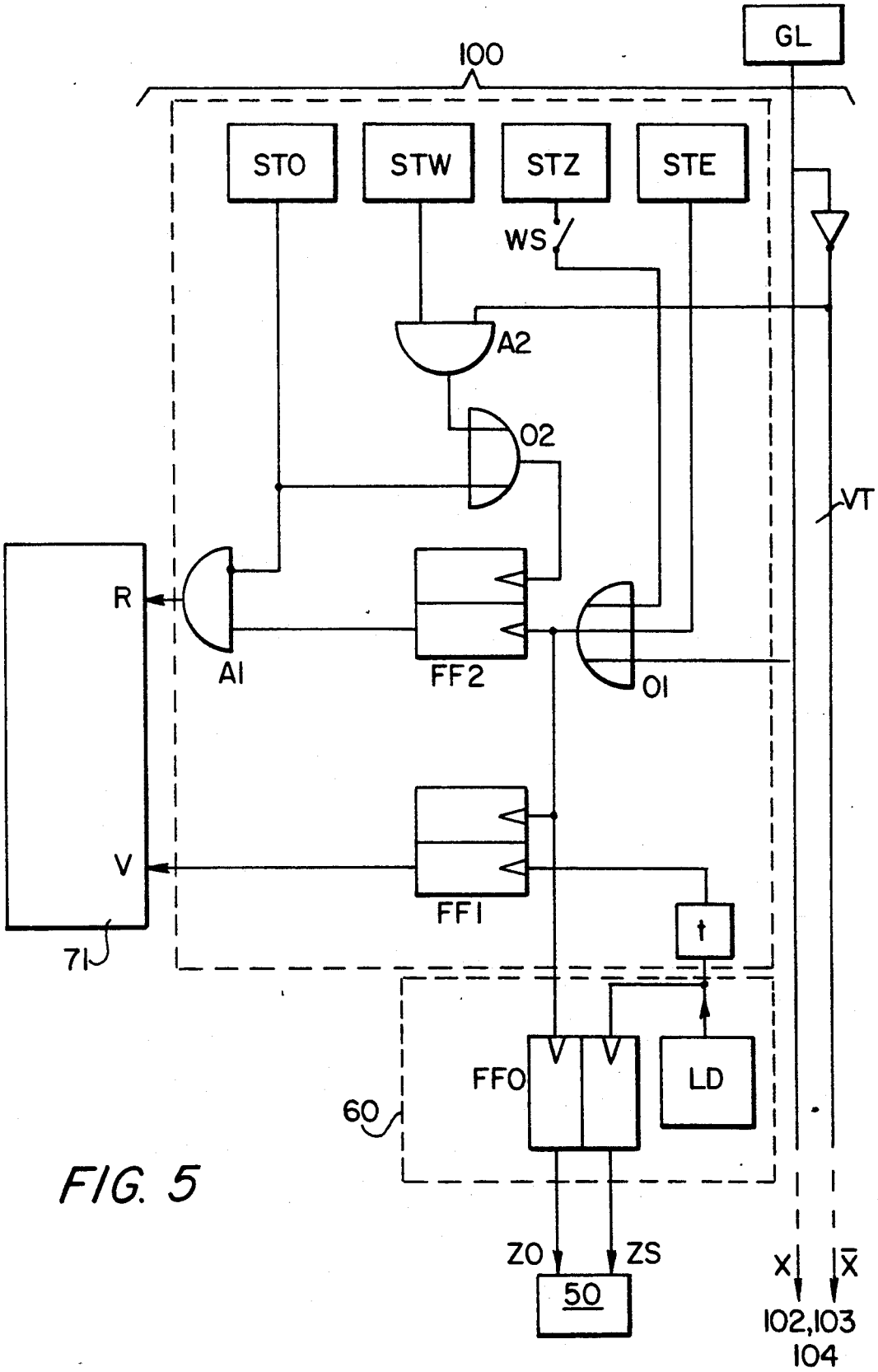
FIG. 5 is a schematic diagram of the control process of the embodiment of FIGS. 1 through 4.

The control process will now be explained with reference to the logic system diagram in FIG. 5.

The drive control means 100 indicated here in the form of a general diagram comprise control channels 101 to 104 that are associated with drive devices 71 to 74. Logic unit GL already referred to delivers its signal X and the inverted signal X' to a distributor VT to which control channels 101 to 104 are connected. The basic structure of control channel 71 is illustrated; the remaining ones are of the same structure and are indicated merely by their reference number at the distributor VT. Channel 101 with its associated functional groups is described in what follows; the description applies correspondingly to the other channels.

Drive device 71 is indicated as a functional unit with control inputs V for "forward movement" (stripping direction) and R for "return movement." These inputs can be triggered alternatively and are interlocked by conventional means (not shown). The gripper control means 60 and gripper positioning means 50 are also indicated as functional units. They are interconnected by control inputs ZO with the function "open grippers" and ZS for "close grippers" associated with the pertinent signal value logical 1. The gripper control means 60 include a leather presence detector LD locally associated with the pertinent gripper, which detector, as has already been pointed out, generates a control signal having the value of logical 1 if material is present in the interior space of the grippers.

The circuitry illustrated includes biflops (flipflops) FF0, FF1, and FF2 as signal storage elements that in the initial state assume their preferred logical state as indicated by "a." As is indicated in the circuit diagram, biflops are involved; they respond to positive input signals only. The remaining elements are mentioned in the description of operation.

Assume that the device is in the initial state as shown in FIGS. 1 and 4; the edge of the leather K has not yet left the roller outlet (differing in this respect from the situation shown in FIG. 4). A leather edge section now enters the pertinent interior space of a gripper, so that LD is activated and FF0 is set, that is, ZS is activated with 1 and the gripper is closed by way of its positioning device 50. After a delay determined by safety considerations and executed by a timing element t1, FF1 is thereby set in control channel 101, and the drive device is activated with control signal 1 at the inlet V to initiate forward movement.

In the initial position, the position indicator ST0 had ended the preceding gripper return by generating an inhibit signal 1 by way of an AND blocking gate (inverting input) A1 at input R. The gripper moving forward now leaves ST0, and input R is freed to prepare for the subsequent return movement, but is not yet activated because FF2 is still in the reset state. In addition, GL now generates the signal $X'=1$, having the meaning "roller discharge area not free of leather," so long as the trailing area of the piece of leather passing through is still in the roller area.

As long as an intermediate position indicator STZ remains inactivated as a result of opening of a pertinent monitoring switch WS and as long as the signal $X=0$ persists, the gripper moves to its end position, and the position indicator STE terminates forward movement by way of an OR gate by resetting FF1. FF0 and FF2 are reset at the same time, that is, on the one hand the gripper is opened and on the other return travel of the gripper is initiated, through activation of R by way of the gate A1 that has been released by ST0 in the meantime. The same occurs when the intermediate position is reached in the event of activation of STZ, because of the signal path assigned by way of WS and 01.

Assignment of the signal path to FF0, FF1, and FF2 by VT, by way of 01, results in opening of the grippers, termination of forward travel, and initiation of return travel in the embodiment described, but this result also occurs when the trailing edge of the leather is leaving the roller outlet, before the gripper reaches the intermediate or end position, and accordingly the signal $X=1$ is generated by way of GD and GL. In this case, then, when passage of a piece of leather has ended, all grippers are opened immediately and are returned to their initial position. This may result in significant saving of operating time.

Figure 6:
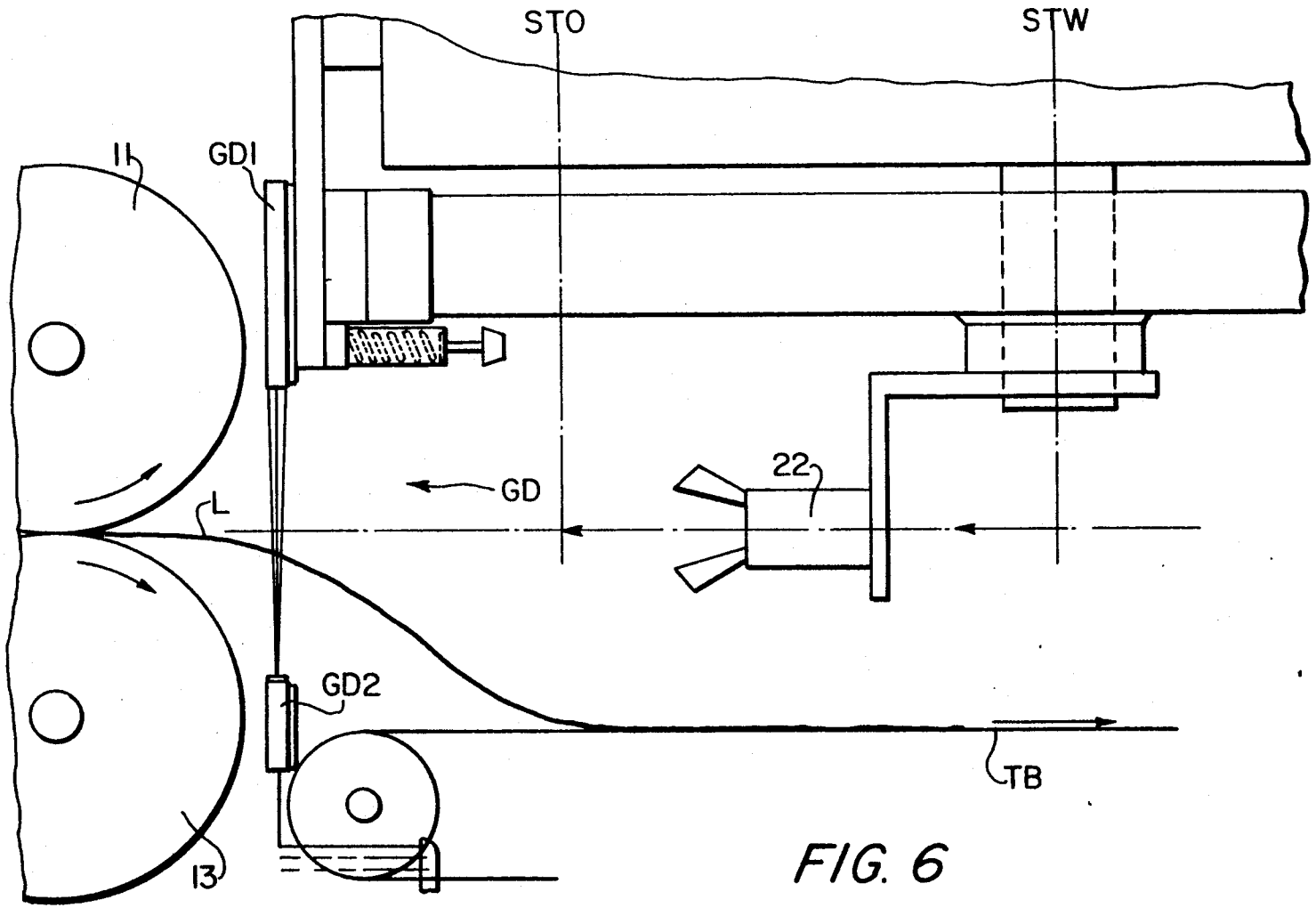
FIG. 6 is a second operating situation wherein the gripping means is in the waiting position.

Provision has also been made for a situation in which advance travel has ended and return travel has been initiated by the activated intermediate position indicator STZ but the piece of leather has not yet left the roller outlet, so that movement of a gripper to its initial position could result in collision with the leather still present there. In this case the signal $X'=1$, which holds an output of the AND gate controlling the output of waiting position indicator STW ready, persists during the gripper return travel initially proceeding as it did at first. If the gripper now reaches STW, the latter blocks return travel by way of A2 and another OR gate 02 by resetting FF2. Hence the gripper initially persists in the waiting position and cannot collide with the leather. An operating situation such as this is shown in FIG. 6. The piece of leather, a large part of whose surface rests on the conveyor belt TB, is carried along by the conveyor belt despite the elimination of the stripping forces on the leading edge of the leather, and the trailing edge also finally leaves the roller discharge area, at which point GD and GL again deliver the signal $X=1$. The corresponding positive signal edge now sets FF2 again by way of 01 and initiates continuation of the return travel. The gripper, arriving at ST0, now for safety considerations blocks the return travel over A1 directly by way of R, and also resets FF2. The entire system is thereby returned to its initial state.

Figure 7:
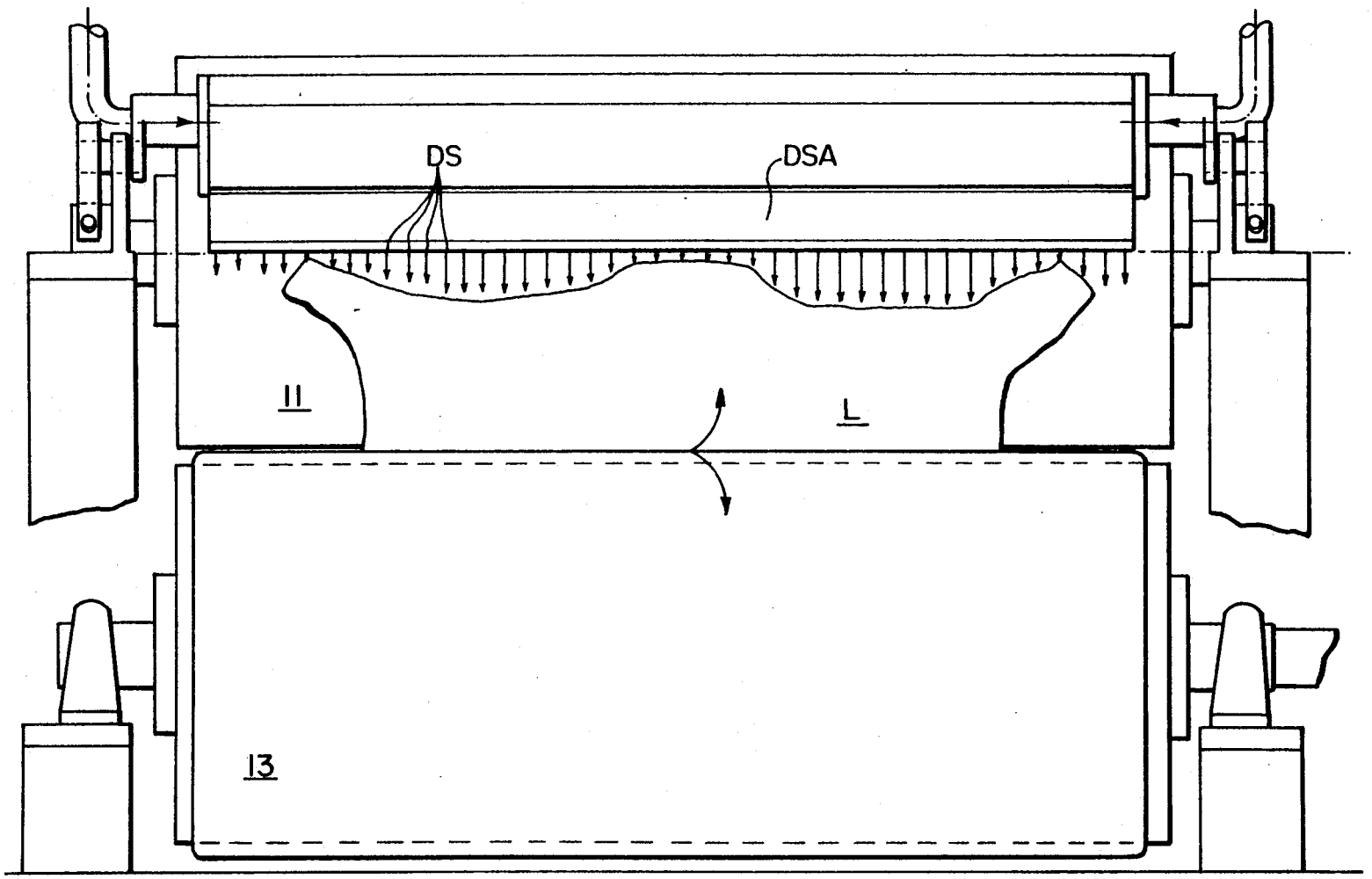
FIG. 7 is a front view of a second embodiment of the present invention.
Figure 8:
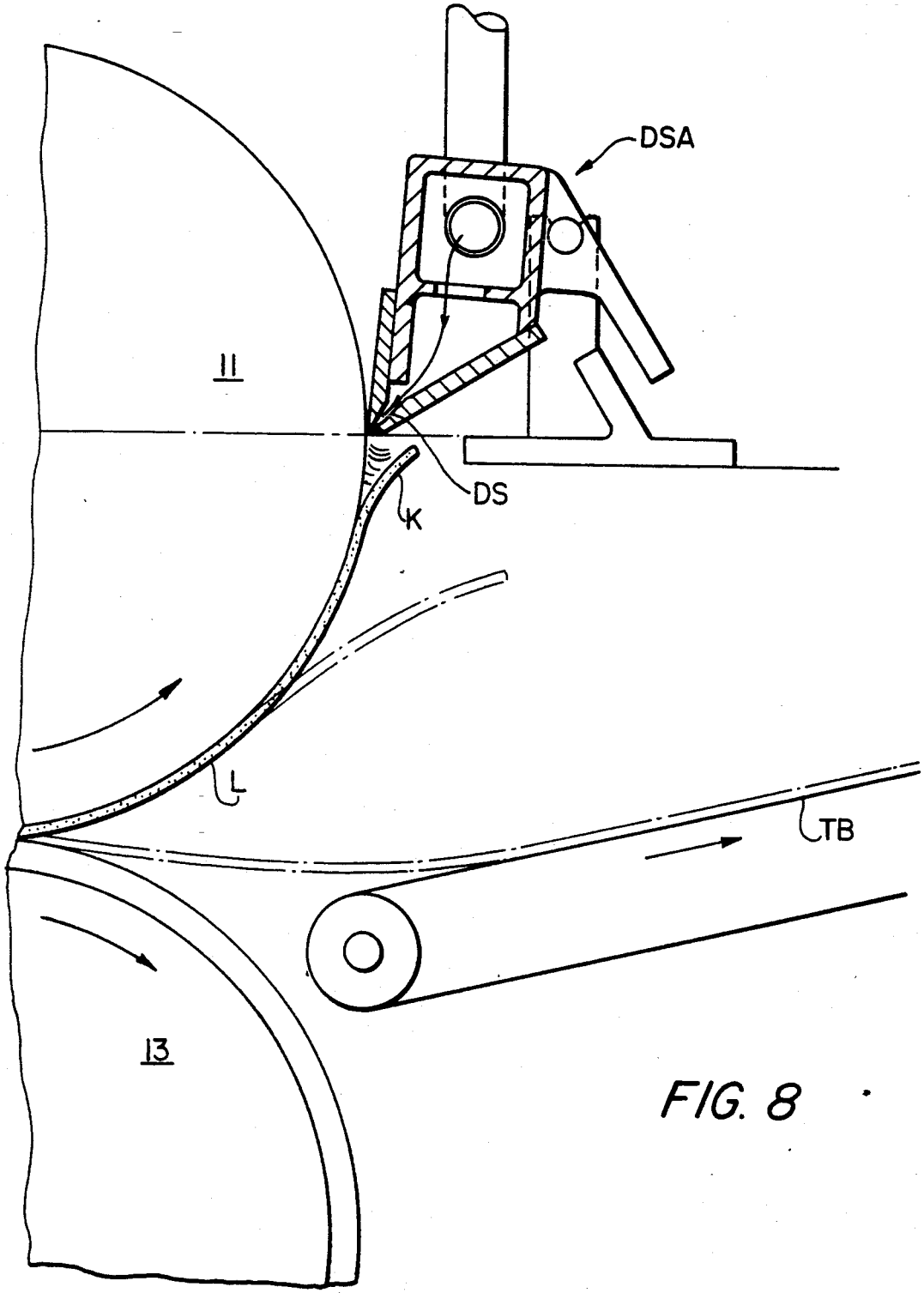
FIG. 8 is a side view of the embodiment of FIG. 7.
Figure 9:
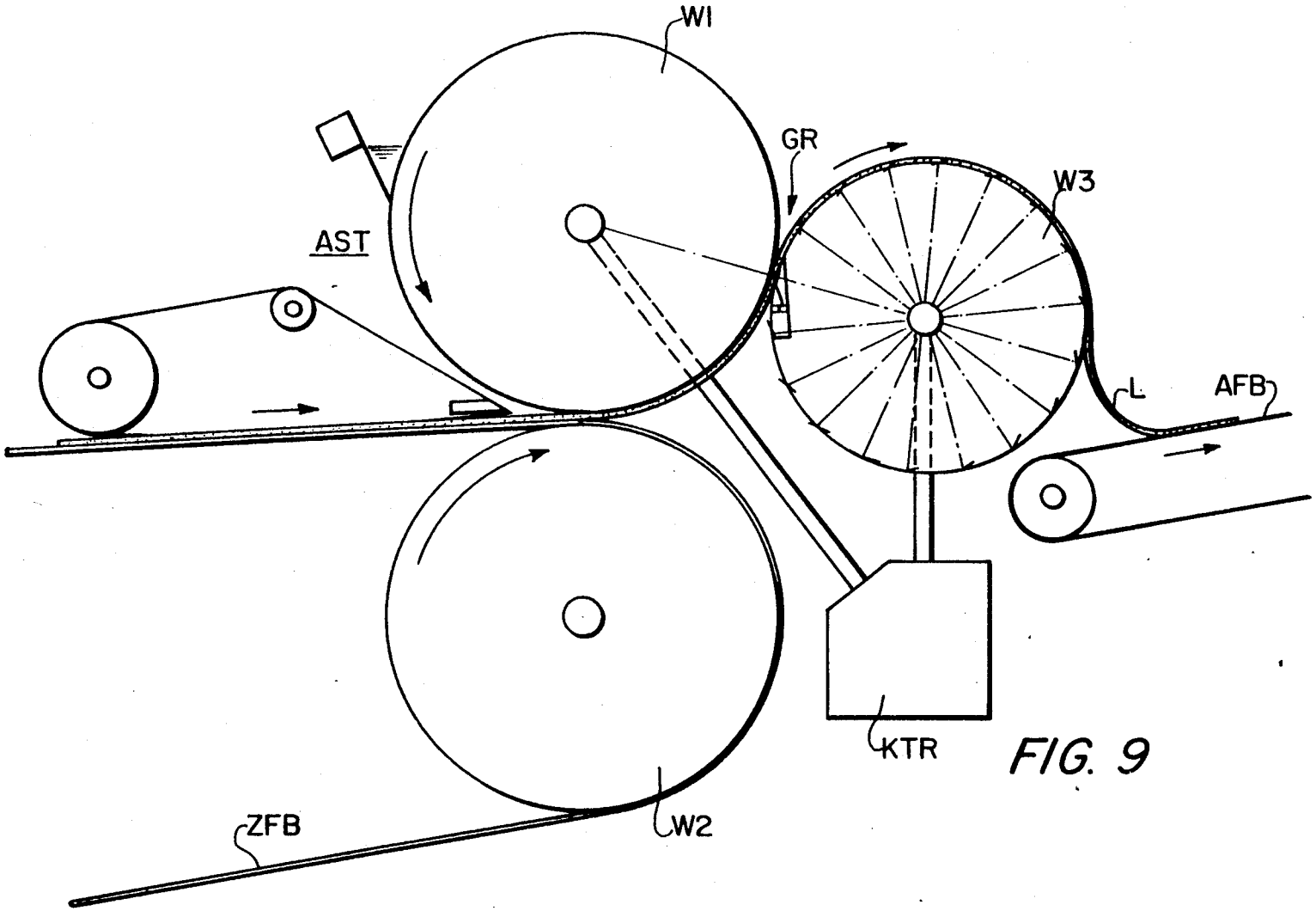
FIG. 9 is a third embodiment of the present invention.
Figure 10:
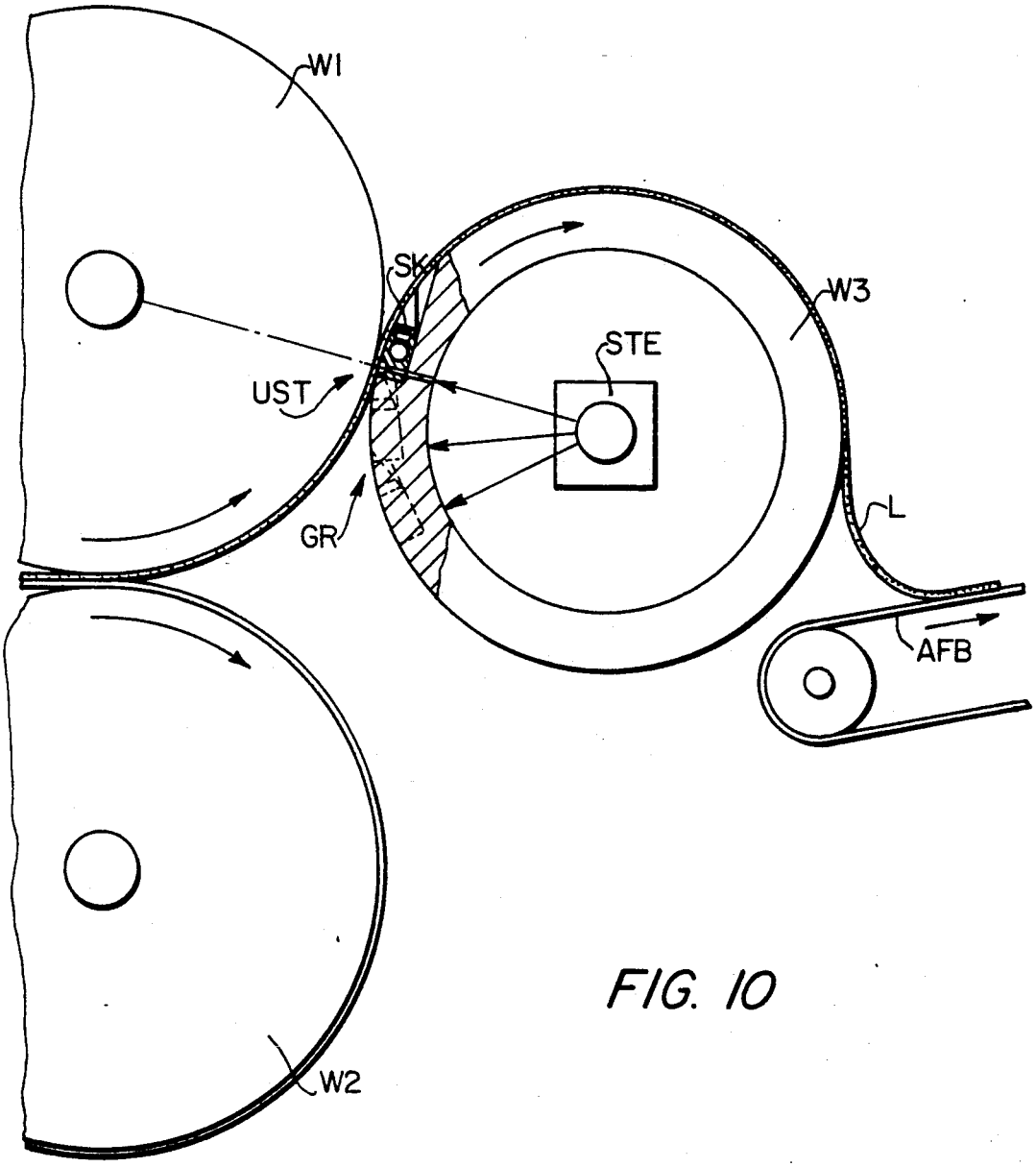
FIG. 10 is an enlarged view of the embodiment of FIG. 9.

FIG. 7 shows another embodiment of a leather staining machine, in the form of a front view of a roller unit corresponding more or less to the first embodiment. The direction of view is horizontal and toward the discharge area of the roller unit. FIG. 8 shows a side view of the roller discharge area corresponding to that in FIG. 2 of the first embodiment. In the version under discussion, a compressed air nozzle unit DSA is provided across the operating width of the roller outlet, in place of mechanical stripping elements. In other respects elements corresponding to the preceding embodiment are provided with the same identification symbols to the extent that this is necessary for understanding. As is to be seen from FIG. 8, the individual nozzles are mounted in the immediate vicinity of the surface of the roller 11 and are directed toward the adhering leather edge K. It is advisable to operate with compressed air blasts that are to be triggered by detection devices as a function of arrival of the leather edge, analogously to the first embodiment. Significant conservation of compressed air is thereby achieved. As is also indicated by broken lines in FIG. 8, the released leather edge drops onto the conveyor belt TB under its own weight and is carried away by the latter without grippers. However, it goes without saying that, if desired, here as well grippers may be provided as in the first embodiment.

FIGS. 9 through 14 illustrate another embodiment of a continuous operation device as claimed for the invention, again on a continuously operating leather imprinting machine as an example of a work station AST. In this instance as well the leather is pressed against the stain roller in the imprinting process by a mating roller W2 with a delivery belt ZFB, and adheres relatively strongly to the surface of the roller W1 because of the still liquid stain. Hence a discharge roller W3 with gripping means GR in the form of a grid distributed over the circumference of the roller, which gripping means mechanically lift the leather, is provided on the outlet side of the pair of rollers. The dry side of the leather then rests on the roller W3 and slides from it onto a removal belt AFB. The rollers W1 and W3 are synchronized by linkage KTR of conventional design, preferably with adjustable transmission ratio, as a function of their peripheral speeds. If desired, any given difference in roller peripheral speeds may be set, for example, a slight lead of the removal roller.

Figure 12:
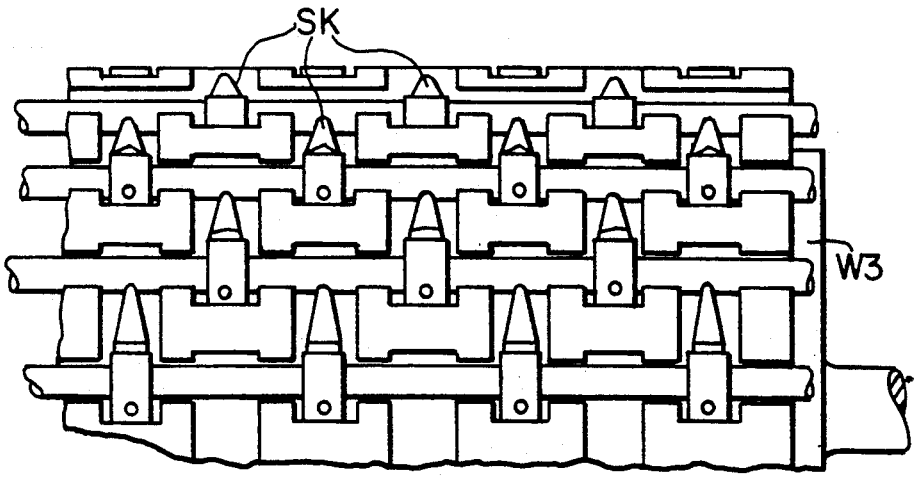
FIG. 12 is an enlarged side view of the roller of FIGS. 9, 10 and 11.

FIG. 12 shows a transfer point between the rollers W1 and W3 on a larger scale. As is indicated diagrammatically here, the gripping means are provided with punching or slotting elements SK designed so that they may be shifted between an active state in which they are applied to the leather and an inactive state in which the leather is released. A positioning device STE synchronized with the passage of the leather or with rotation of the rollers is provided for activation and inactivation of the punching or slotting elements SK. As a result of coupling with the roller W3, this positioning device STE causes shift of the punching or slotting elements (generally referred to as pricking elements) SK between the active and the inactive state to be synchronized with passage of these elements by the transfer point UST.

Figure 11:
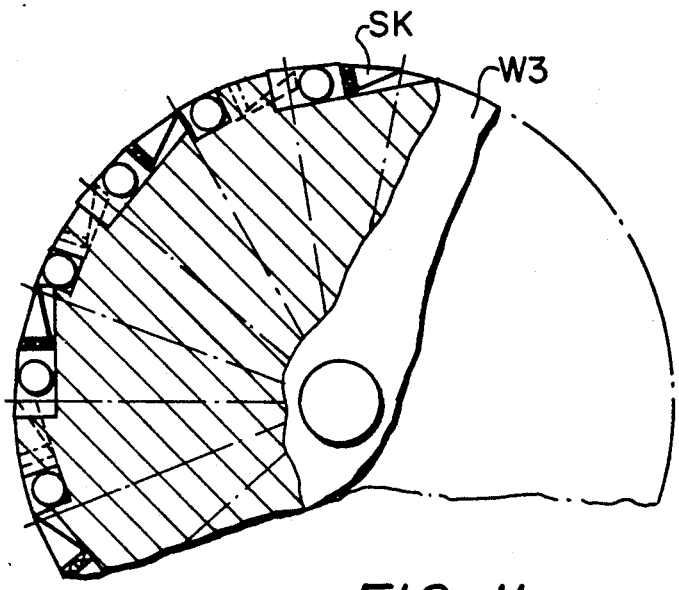
FIG. 11 is an enlarged sectional view of the embodiment of FIGS. 9 and 10 showing the distribution of gripping means over the roller.
Figure 14:
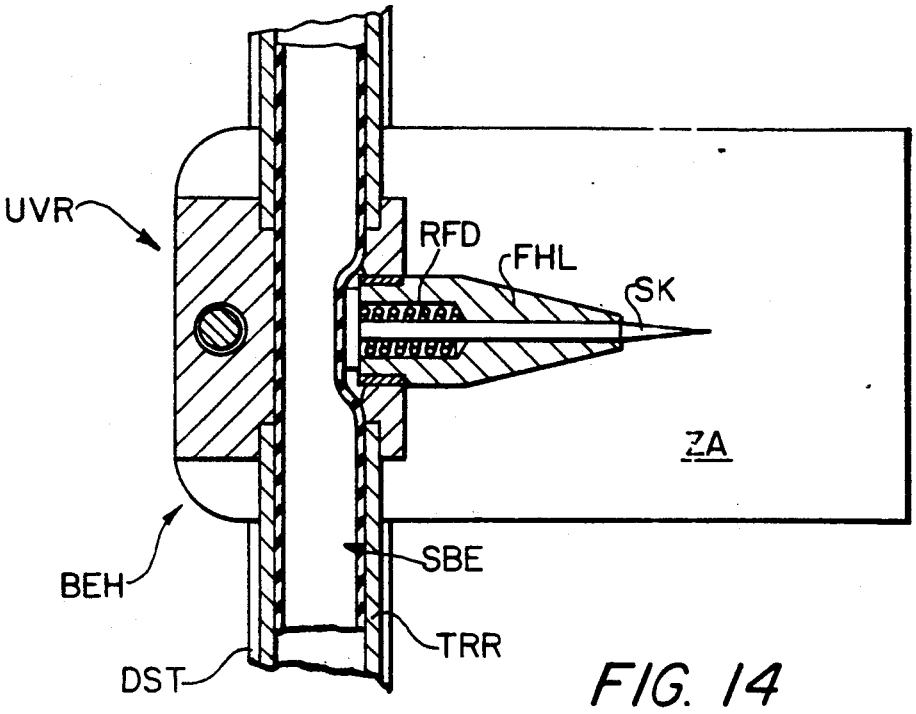
FIG. 14 is a view of the embodiment of FIGS. 9 through 12 showing the punching element in the active state.
Figure 13:
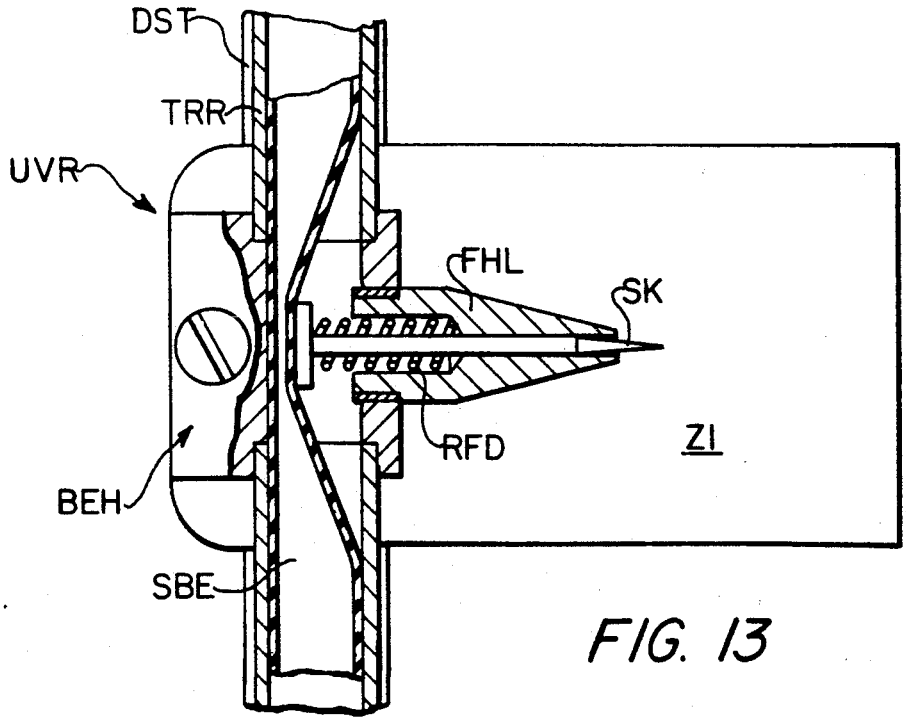
FIG. 13 is a view of the embodiment of FIGS. 9 through 12 showing the punching element in the inactive state.

The gridlike distribution of the punching or slotting elements over the surface of the roller W3 is shown in detail in FIGS. 11 and 12. For the purpose of even separation of the leather from the stain roller, a provision is made whereby the punching or slotting elements arranged in a row extending more or less in the longitudinal direction of the rollers may be shifted together between an active and an inactive state. FIGS. 13 and 14 show on a larger scale a structural unit BEH with a punching or slotting element SK in the inactive state ZI and active state ZA. In the embodiment exemplified, the punching or slotting elements SK are designed in the form of needles, and a common, preferably fluid operated, reversal device UVR is provided for activation and inactivation for the punching or slotting elements arranged in a row extending more or less in the longitudinal direction of the rollers. In the embodiment exemplified, the punching or slotting elements are mounted in a guide sleeve FHL so that they may be shifted between the active and the inactive state and are placed under tension by a repositioning spring in the direction of one of their operating states, preferably in the direction of the inactive state. It is advantageous to give consideration also to a suitable swivel mount.

The common fluid operated reversal device UVR comprises at least one hose or bellows element SBE that acts on the punching or slotting elements in order to cause swivelling and that can be loaded with and relieved of hydraulic fluid. This hose or bellows element SBE is directed, for one row of punching or slotting elements, in aligned support pipes TRR that are fastened in longitudinal grooves in the roller jacket and conform to the shape of the latter, and that connect the structural units BEH of one row to each other. Spacer pipes DST secure the structural units in place.

The elements SBE, which preferably are designed as simple and sufficiently flexible hoses, are connected by way of conventional hydraulic fluid control means (accordingly not described in further detail) to a source of hydraulic fluid. These control means comprise a control valve of conventional design that may be selectively activated for each row of punching or slotting elements. As it passes the transfer point, the element SBE of the pertinent row is loaded with hydraulic fluid and thus expanded, for example, by a peripheral cam arrangement of conventional design already contained in the synchronous positioning device already referred to and acting in conjunction with the shaft of the roller WE. Consequently, the punching or slotting elements of the row are transferred to their active state against the action of the repositioning spring RFD and are pressed into the nonsensitive reverse or flesh side of the leather. As the roller continues to rotate, the leather is then diverted into a direction tangential to the circumference of the roller W3 and is accordingly separated from the stain roller W1. Immediately afterward the hose or bellows element SBE is relieved of pressure by the synchronous control unit, and the punching or slotting elements release the leather and return to the inactive state.

It goes without saying that more or less any suitable conventional hydraulic fluid or electromagnetic valve systems may be used for purposes of control. Preference may be given to use of a compressed air drive system to shift the punching or slotting elements, but appropriate hydraulic systems may also be used to advantage, depending on the service conditions.

It is especially advantageous in the case of a compressed air system to have a design such that the hollow body of a roller is connected to a compressed air line by way of a delivery coupling and serves as a compressed air storage unit.

We claim:

1. A continuous-operation device for the treatment of a leather piece and similar materials, comprising:

a work station including a roller unit, said roller unit including a pair of rollers through which said leather piece is moved, said work station including an inlet side and an outlet side, a path upon which said leather piece is moved, said path extending from said inlet side and through said work station to said outlet side, a gripping means for removal of said leather piece from one roller of said pair of rollers as said leather emerges from said work station outlet side and for movement of said leather piece after it emerges from said work station outlet side, a drive means for driving said gripping means, said gripping means being operatively connected to said work station outlet side and movably mounted on said drive means.

2. The device as claimed in claim 1, said roller unit having an operating width, said gripping means further including a plurality of grippers distributed over said roller unit operating width, said grippers gripping the edge of the leather piece.

3. The device as claimed in claim 2, further comprising a means for adjusting the position of at least one of said plurality of grippers transversely relative to said path of said leather piece along said roller unit operating width.

4. The device as claimed in claim 3, wherein said means for adjusting the position of at least one of said plurality of grippers comprises a selectively activated transverse adjustment device operatively connected to said at least one of said plurality of grippers, and a selectively activated transverse control device having a plurality of assigned and transverse position settings for selectively activating said transverse adjustment device.

5. The device as claimed in claim 1, wherein said gripping means has at least one gripper, said at least one gripper including a pair of tongs movable between an open position and a closed position.

6. The device as claimed in claim 5, wherein said roller unit includes an associated conveyor belt surface and said gripper includes at least one clawlike gripping element having a stripper at a tip area thereof, said gripping element mounted in a discharge position near said roller unit conveyor belt surface.

7. The device as claimed in claim 1, wherein said gripping means is movable between an open position and a closed position, the device further comprising:

at least one detecting means operatively connected to said gripping means for establishing the presence of leather in the gripping area, and a gripper control means for activating the closing and opening of said gripping means.

8. The device as claimed in claim 5, further comprising at least one detecting means operatively connected to said gripping means for establishing the presence of leather in the gripping area, and a gripper control means for activating the closing and opening of said gripping means.

9. The device as claimed in claim 8, further comprising at least one sensor unit for said at least one gripper for scanning the interior of said tongs.

10. The device according to claim 2, further comprising:

a stripping and drive device provided for separately driving a plurality of gripping means; and drive control means for controlling said stripping and drive device, said drive control means including a drive control channel for each of said gripping means.

11. The device according to claim 10, wherein said stripping and drive device is reversible for return travel of said gripping means, said drive control means activating return travel of said stripping and drive device.

12. The device according to claim 11, further comprising a detector device covering substantially the operating width of said roller unit to monitor the discharge area of said roller unit for freedom of said leather piece therefrom.

13. The device according to claim 12, wherein said detector device is operatively connected to said drive control means.

14. The device according to claim 12, wherein said detector device is operatively connected with said return control activation of said drive control means.

15. The device according to claim 12, wherein said detector device is operatively connected to said drive control means and interrupts return travel movement in progress until the discharge area of the roller unit is cleared of emerging material by stopping the gripping means in an assigned waiting position.

16. The device according to claim 1, further comprising means for moving said gripping means in a forward and reverse direction and at least one gripper position detector for monitoring the forward or reverse movement of said gripping means.

17. The device according to claim 16, further comprising at least one adjustable-position gripper position indicator.

18. The device according to claim 17, wherein said gripper position indicator is in operational return travel activation connection with said drive means.

19. The device according to claim 16, wherein said gripper position detector is in operational return travel activation connection with said drive means.

20. The device according to claim 1, wherein said gripping means has at least one pricking element that acts on said leather piece.

21. The device according to claim 20, further comprising a leather guiding roller located at said work station outlet side, wherein said pricking element is mounted on the circumference of said leather guiding roller.

22. The device according to claim 20, wherein said pricking element includes a means for switching said element from an active state in which said element is applied to said leather piece and an inactive state in which said leather piece is released.

23. The device according to claim 22, wherein said element switching means comprises a positioning device synchronized with the passage of the leather.

24. The device according to claim 22, further comprising a work station including a pressure roller unit and a discharge roller having a circumference, the work station located in advance of the discharge unit, wherein the gripping means is mounted on the discharge roller circumference and wherein the pressure roller unit has a transfer point located on the discharge roller circumference.

25. The device according to claim 24, wherein when the pricking element passes by said transfer point, the switching means is activated to move said pricking element between the active and inactive states.

26. The device according to claim 21, further comprising a leather guiding roller having a circumference, wherein a plurality of pricking elements are mounted in a gridlike pattern distributed over said leather guiding roller circumference.

27. The device according to claim 26, wherein said plurality of pricking elements extend in a row along the generally longitudinal length of said leather guiding roller, and wherein said plurality of pricking elements can be switched together between said active and inactive states.

28. The device according to claim 27, further comprising a reversal device for activation and deactivation of the pricking elements.

29. The device according to claim 28, wherein said pricking elements are movable between said active and inactive states, and wherein said reversal device includes at least one bellows element that may be charged with and relieved of hydraulic fluid and that acts on the pricking elements in the direction of movement.

30. The device according to claim 28, further comprising a spring operating on said pricking elements, wherein said pricking elements are movable between said active and inactive states, and wherein said pricking elements are placed in tension in the direction of said inactive state by said spring.

31. The device according to claim 20, wherein said at least one pricking element is a needle.

32. The device according to claim 21, further comprising a pneumatic reversal device for said pricking element, and further comprising a compressed air storage unit in the body of the roller and connected to a compressed air delivery line.

33. A continuous-operation device for the treatment of leather and similar materials, comprising:

a work station including a roller unit including a pair of rollers and through which said leather piece is moved, said work station including an inlet side and an outlet side, a conveyor belt upon which said leather piece is moved, said conveyor belt extending form said inlet side and through said work station to said outlet side, stripping means for removal of said leather piece from one roller of said pair of rollers as said leather emerges from said work station outlet side, said stripping means being connected to said work station outlet side for releasing the emerging material from the conveyor belt, said stripping means having at least one compressed air nozzle directed toward the emerging edge of material.

* * * * *